US008777501B2

(12) United States Patent
Garcia et al.

(10) Patent No.: US 8,777,501 B2
(45) Date of Patent: Jul. 15, 2014

(54) MEDIA LOADING DEVICES

(75) Inventors: Daniel Guiterrez Garcia, Barcelona (ES); Ignacio Picatoste Olloqui, Barcelona (ES); Laura Sanchez Domingo, Barcelona (ES); Oriol Moliner Rafa, Sant Cugat del Valles (ES); Ezequiel Jordi Rufes Bernad, Sant Feliu de Llobregat (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 281 days.

(21) Appl. No.: 13/105,139

(22) Filed: May 11, 2011

(65) Prior Publication Data

US 2012/0288315 A1 Nov. 15, 2012

(51) Int. Cl.
*B41J 13/22* (2006.01)
*B41J 15/04* (2006.01)

(52) U.S. Cl.
CPC ..... *B41J 13/22* (2013.01)
USPC ..... 400/613.1; 271/9.09

(58) Field of Classification Search
CPC ..... B65H 5/28; B41J 13/22; B41J 15/04
USPC ..... 400/613.1
See application file for complete search history.

(56) References Cited

U.S. PATENT DOCUMENTS

| | | | | |
|---|---|---|---|---|
| 3,788,536 | A * | 1/1974 | Brown | 226/91 |
| 4,545,517 | A * | 10/1985 | Olson | 226/92 |
| 4,673,306 | A | 6/1987 | Rubinstein et al. | |
| 4,822,017 | A * | 4/1989 | Griesmyer | 271/2 |
| 5,048,987 | A * | 9/1991 | Golden | 400/613.1 |
| 5,087,238 | A * | 2/1992 | Olson | 493/379 |
| 5,307,579 | A * | 5/1994 | Clayton et al. | 40/600 |
| 6,065,885 | A * | 5/2000 | Bodapati et al. | 400/622 |
| 6,595,460 | B1 | 7/2003 | Jones | |
| 6,739,257 | B1 | 5/2004 | Velez et al. | |
| 7,338,156 | B2 | 3/2008 | Janssen et al. | |
| 2005/0047840 | A1 * | 3/2005 | Ohashi | 399/388 |
| 2010/0260529 | A1 | 10/2010 | Dobkin et al. | |

FOREIGN PATENT DOCUMENTS

| | | | | |
|---|---|---|---|---|
| JP | 02045180 | A * | 2/1990 | B41J 13/22 |
| JP | 06143809 | A * | 5/1994 | B41J 2/32 |
| JP | 2002316754 | A * | 10/2002 | B65H 19/29 |

OTHER PUBLICATIONS

"Flexible Magnet for Wide-format Inkjet Printers"; http://www.magnummagnetics.com/wide-format/.

* cited by examiner

*Primary Examiner* — Nguyen Ha

(57) ABSTRACT

A media loading device includes a detachable stiffener that is detachably connected to a leading portion of a soft media and supports the leading portion of the soft media during threading of the soft media through a media path of a printer. A method for loading soft media includes detachably connecting a leading edge of soft media onto a detachable stiffener and placing the detachable stiffener and soft media into a printer. The detachable stiffener and soft media are fed through the media path in the printer.

17 Claims, 8 Drawing Sheets

MEDIA LOADING DEVICES

BACKGROUND

Soft media is frequently used as a substrate for printing. Soft media can be formed from a variety of compliant materials such as polymer films, woven fabrics, porous films or other thin and flexible materials. When printed with a desired image, the soft media can be used as banners, flags, covers for three dimensional shapes, and other applications. The soft media has a tendency to easily bend, fold, and wrinkle. This can make soft media challenging to thread through a media path in a printer.

BRIEF DESCRIPTION OF THE DRAWINGS

The accompanying drawings illustrate various examples of the principles described herein and are a part of the specification. The illustrated examples are merely examples and do not limit the scope of the claims.

Throughout the drawings, identical reference numbers designate similar, but not necessarily identical, elements.

DETAILED DESCRIPTION

Soft media may lack the rigidity that allows stiffer media to be easily loaded into a printer. Attaching a media loading device to the leading edge of the soft media provides additional rigidity to prevent undesirable wrinkling, folding and bending of the soft media during the loading process. The media loading device is attached to the leading edge of the soft media and is inserted into the media path of the printer. The media loading device is designed to pass through the media path and pull the soft media behind it. When the media loading device exits the opposite side of the media path, the media loading device can be removed from the soft media. The printer can then automatically manipulate the threaded soft media. The use of the media loading device can significantly reduce the amount of time used in threading soft media through the printer. Additionally, previous design constraints within the media path to accommodate soft media loading may no longer be necessary.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

Typically threading media includes placing the media into an opening in the printer and pushing the media through the opening until the media engages with internal drive rollers.

Figure 1:
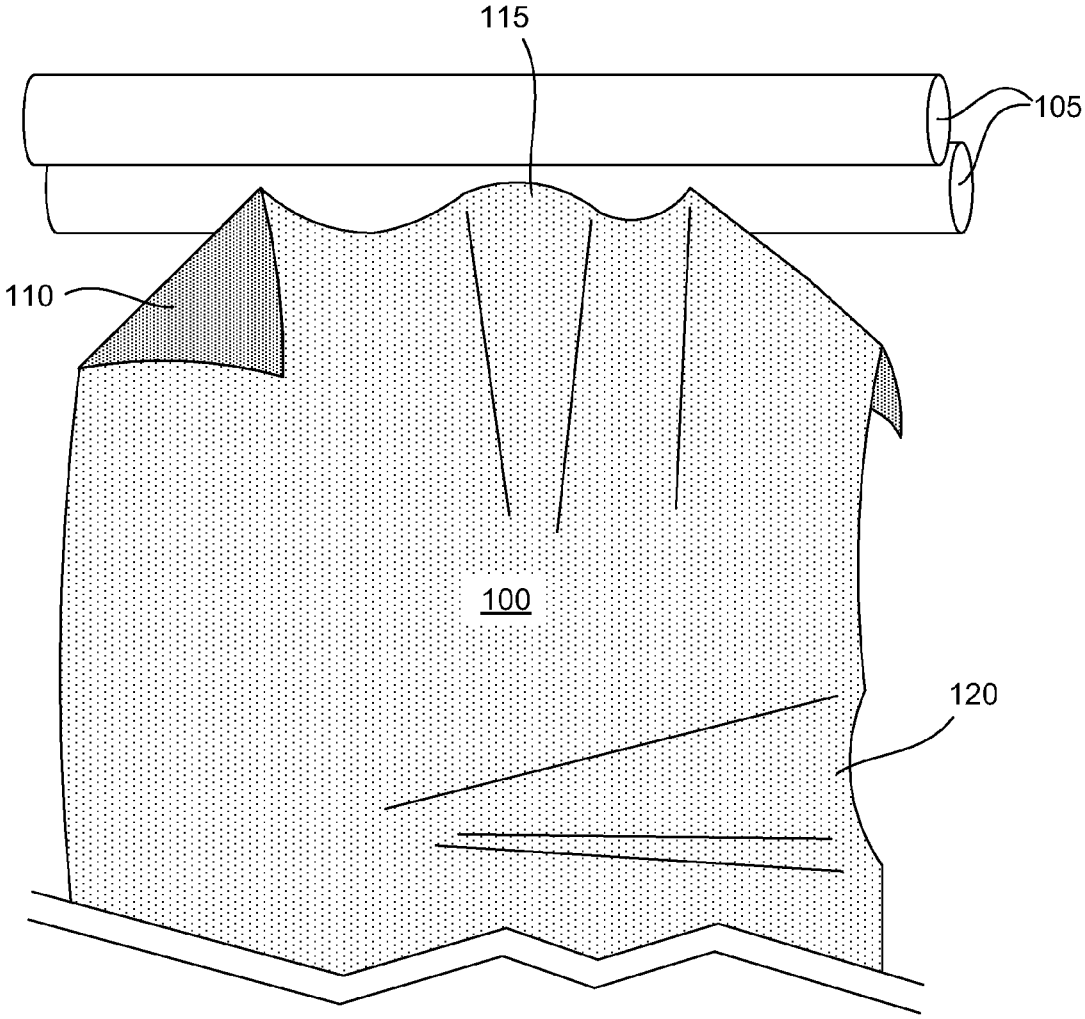
FIG. 1 is a diagram of illustrative soft media being loaded into a printer, according to one example of principles described herein.

FIG. 1 is a diagram of illustrative soft media (100) being loaded into a printer. In this example, the printer is represented by two rollers (105). The rollers (105) may or may not be powered. As discussed above, the soft media (100) is a very compliant material that has a tendency to wrinkle, fold and bend during the loading process. The soft media (100) can typically support tensile loads, but lacks the rigidity to support even small compressive loading. Consequently, it can be difficult to push the leading portion of the soft media (100) into the printer. As shown in FIG. 1, the soft media (100) has a folded corner (110), wrinkles (115) across the leading edge, and buckling (120) in the center. This wrinkling and folding can result in significant threading challenges. The folded corner (110) may leave the media path inside the printer and become entangled in the printer mechanisms. The wrinkles (115) may propagate down the length of the media and become creased as they pass through the printer.

The soft media can be successfully threaded through the media path. However, printers typically do not support automatic threading of soft media. Threading of soft media is a manual process that involves several tedious operations. This process takes additional time on the part of the printer operator and reduces the throughput of the printer. Additionally, the printers may incorporate a number of special adaptations to support this manual threading process. For example, the media path may be relatively open to allow access for the operator to pull the soft media through the media path from a number of points and to provide access to adjust the soft media. This open architecture can include removable covers, movable rollers, and other adaptations. For example, in the Hewlett Packard LX800/LX600 line of industrial printers, the scan axis can be raised to provide enough space to thread the soft media through media path. These adaptations can increase the size, cost, and complexity of the printers.

A significant cost and time savings can be realized by providing a more effective way of threading soft media through the printer. Ideally, the threading of the soft media would mimic the loading process for more rigid substrates such as paper. This would allow the automatic feeding of the soft substrate using mechanisms that are already in place to load the more rigid substrates.

Figure 2A:
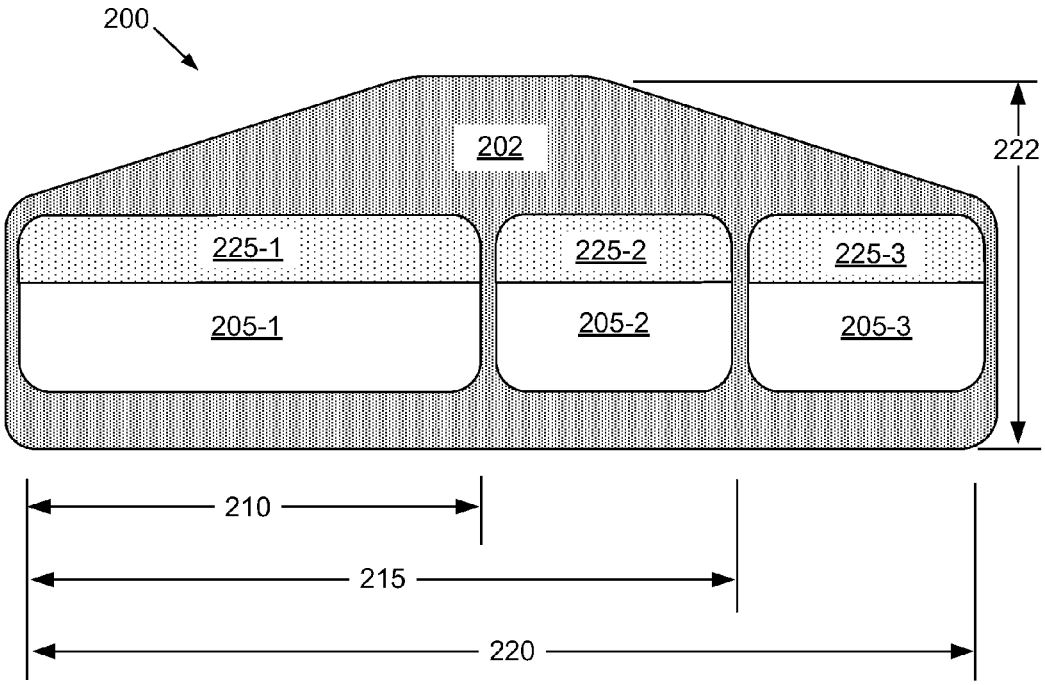
FIGS. 2A and 2B are top views of an illustrative media loading device, according to one example of principles described herein.
Figure 2B:
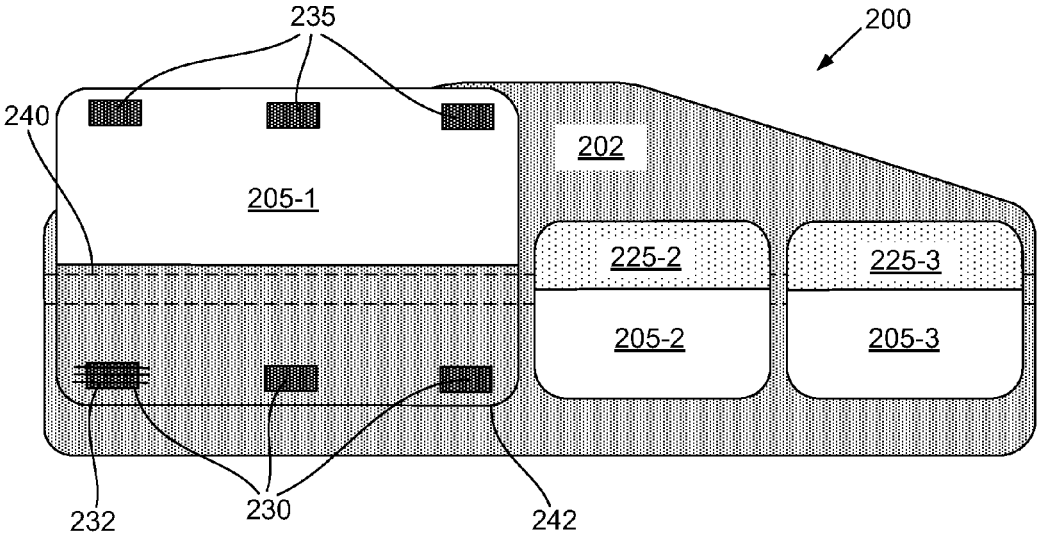

FIGS. 2A and 2B are top views an illustrative soft media loading device (200). In this example, the soft media loading device (200) includes a detachable stiffener (202) and several flaps (205) that are attached along one edge to the detachable stiffener (202) by a hinge (225). The flaps (205) are distributed across the width of the detachable stiffener (210) and may have varying widths. The arrangement and width of the flaps may be selected to conveniently accommodate a range of media widths. For example, the left most flap (205-1) may be larger than the other flaps (205-2, 205-3). This allows the left most flap (205-1) to secure the leading portion of a media with a first width (210). The center flap (205-2) is smaller. The combination of the larger flap (205-1) and the center flap (205-2) allows these two flaps to secure another common media width (215). The right flap (205-3), when used in combination with the other flaps (205-1, 205-2) allows the soft media loading device (200) to accommodate the width (220) of the widest soft media used in this particular design.

The height (222) of the detachable stiffener (202) is designed to allow the detachable stiffener (202) to be pushed into the media opening and extend to the internal drive rollers. After the internal drive rollers engage the front of the detachable stiffener (202), the media loading device (200) is advanced automatically through the media path without further operation intervention. The media loading device (200) pulls the soft media through the media path. In this example, the front or leading edge of the detachable stiffener (202) has been narrowed so that the center portion of the leading edge extends farther than other portions. This tapered geometry allows the more flexible central portion of the detachable stiffener (202) to enter the drive rollers first and pull the remainder of the detachable stiffener (202) through.

The illustrative media loading device (200) is flexible enough to pass through the media path without adjustment or redesign of the components in the media path. The detachable stiffener (202) may be formed from a variety of flexible substrates including polymers, metal, cellulose based materials, or other suitable materials. According to one example, the detachable stiffener (202) is a polymer film that can be printed on the printer. To increase the flexibility and reduce the cost of the detachable stiffener (202), the polymer film is relatively thin while being sufficiently robust against bowing, folding, and collapse. The detachable stiffener (202) may be textured to provide additional gripping power between the detachable stiffener and the media and/or between the detachable stiffener and the drive rollers. The flaps (205) may also be formed from a polymer film. In some examples, both the detachable stiffener (205) and the flaps (205) can be formed from polymer film.

FIG. 2B is a diagram that shows the illustrative media loading device (200) with the left most flap (205-1) open. In this example, three flexible magnets (235) are adhered to the underside of the flap (205-1). The flexible magnets (235) can be formed from a mixture of flexible resin and magnetic powders. For example, the flexible magnets may be formed using injection molding, extrusion molding or strip molding. In some implementations, the flexible magnets may include a self adhesive backing that allows the magnets to be cut and adhered to the detachable stiffener (202) and flaps (205) without additional adhesive. In other examples, an added layer of adhesive or epoxy may be used to hold the magnets in place.

Three corresponding flexible magnets (230) are adhered to the detachable stiffener (202). The magnetic poles of the magnets (235) on the flaps (205) and the magnets (230) on the detachable stiffener (202) are aligned so that they adhere to each other in pairs to hold the flaps (205) shut. When soft media is placed between the flaps (205) and the detachable stiffener (202), the soft media is sandwiched between the magnet pairs. This grips the soft media and prevents it from pulling out from under the flaps (205) as it is threaded through the printer.

In one implementation, the magnetic line orientation of the flexible magnets (230, 235) is perpendicular to the feed direction of the soft media. The magnetic line orientation is illustrated by the parallel horizontal lines (232) across the magnet (230) in the lower left hand portion of the detachable stiffener (202). The same magnetic line orientation is maintained across all of the magnets, but using opposite polarities between magnet pairs. This magnetic line orientation may provide a number of benefits including reducing the likelihood that magnets will become detached when bending around rollers in the media path. The magnetic line orientation allows for some differential motion between the magnet pairs while maintaining a substantial amount of the magnetic force that holds the magnetic pairs together.

In one implementation, the sheet of polymer film from which the detachable stiffener (202) and flaps (205) are formed is printed on the same printer they will later be used in as a loading device. The outlines (242) of the various components are printed onto the polymer film. This allows the components to be quickly and accurately positioned on the detachable stiffener (202) during the assembly process. Additionally, the instructions for use of the media loading device (200) can be printed directly on the detachable stiffener (202) or flaps (205). In one example, alignment marks (240) may be printed on the detachable stiffener (202) to assist the operator in aligning a leading edge of the soft media with the media loading device (200).

After printing the outlines (242) and alignment marks (240) on the polymer film, the components are cutout and assembled. In one example, the assembly involves attaching the flaps (205) to the detachable stiffener (202) using fabric tape. This creates a hinge joint (225) along the leading edge of the flaps (205). A variety of other techniques could be used to attach the flaps (205) to the detachable stiffener (202). For example, the leading edge of the flaps (205) could be glued or heat welded to the detachable stiffener (202). As described below, flexible magnets (230,235) are adhered to the flaps (205) and detachable stiffener (202). This can result in a relatively low cost loading device that can be readily manufactured using media that is already suited to pass through the printer.

As used in the specification and appended claims, the term "leading" refers to portions of the media loading device or soft media that are first to advance into the media path. Similarly, the term "trailing" refers to portions of the media loading device that are last to advance through the media path.

FIGS. 3A-3F are diagrams of various stages in an illustrative process for using the media loading device to thread soft media through a media path in a printer. FIG. 4 is a flowchart of an illustrative method for loading soft media through a media path of a printer using a media loading device. Each block in FIG. 4 is associated with one of the figures shown in FIGS. 3A-F.

Figure 3A:
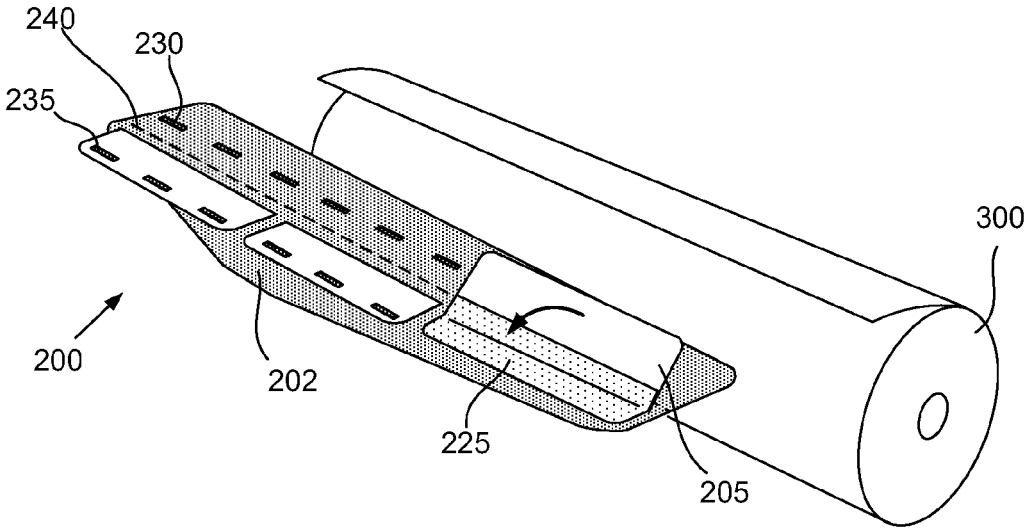
FIGS. 3A-3F are diagrams of an illustrative process for using the illustrative soft media loading device to thread soft media through a media path in a printer, according to one example of principles described herein.
Figure 4:
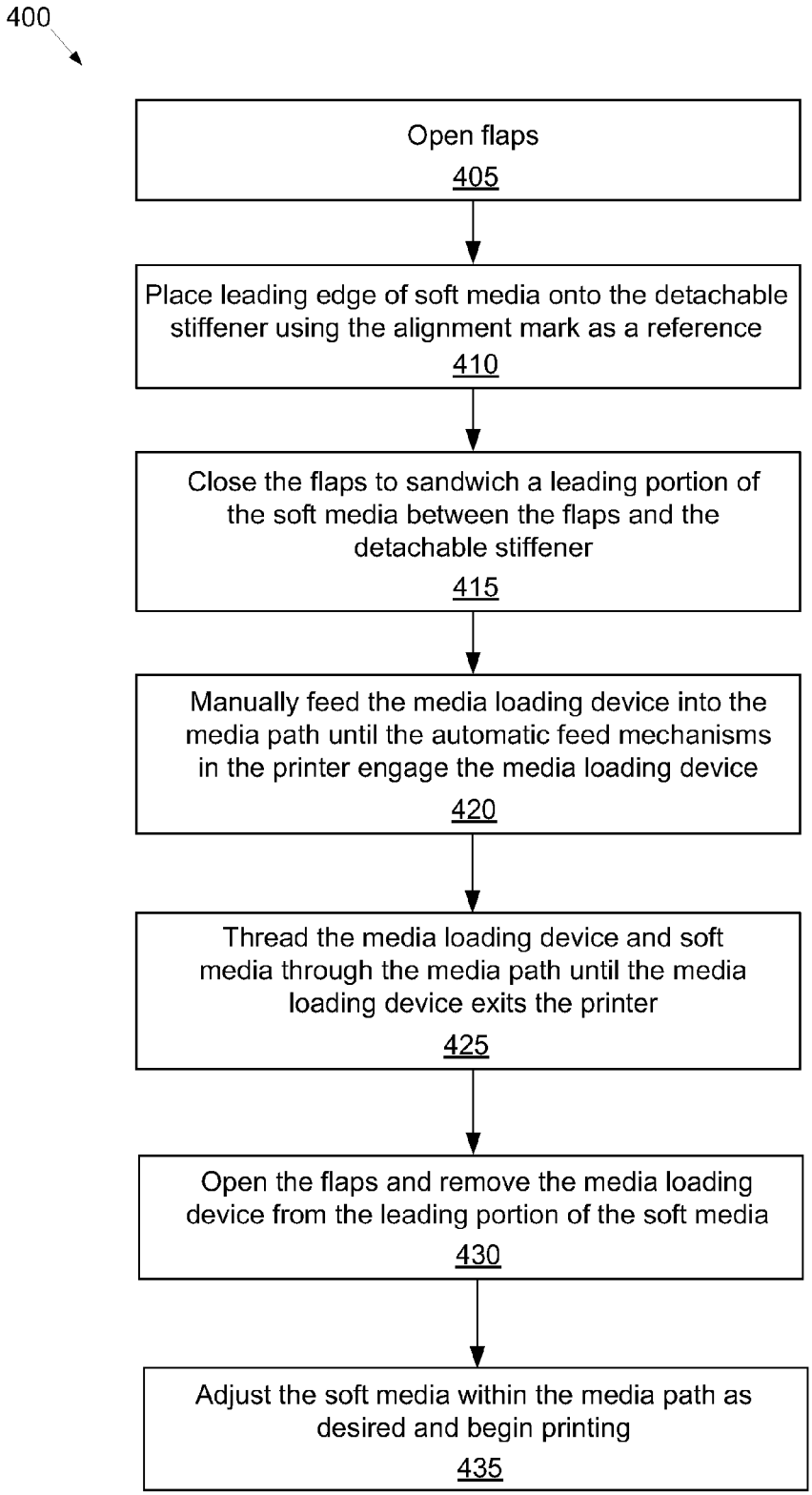
FIG. 4 is a flowchart of an illustrative method for loading soft media through a media path of a printer using a soft media loading device, according to one example of principles described herein.

FIG. 3A shows the loading device (200) positioned in front of a roll of soft media (300). The flaps (205) are opened (block 405). The flaps (205) are opened by manually pulling upward on the edge of the flaps that are opposite the hinge (225). This overcomes the magnetic attraction between the magnet pairs (230, 235). The alignment mark (240) located under the flap (205) is then exposed.

Figure 3B:
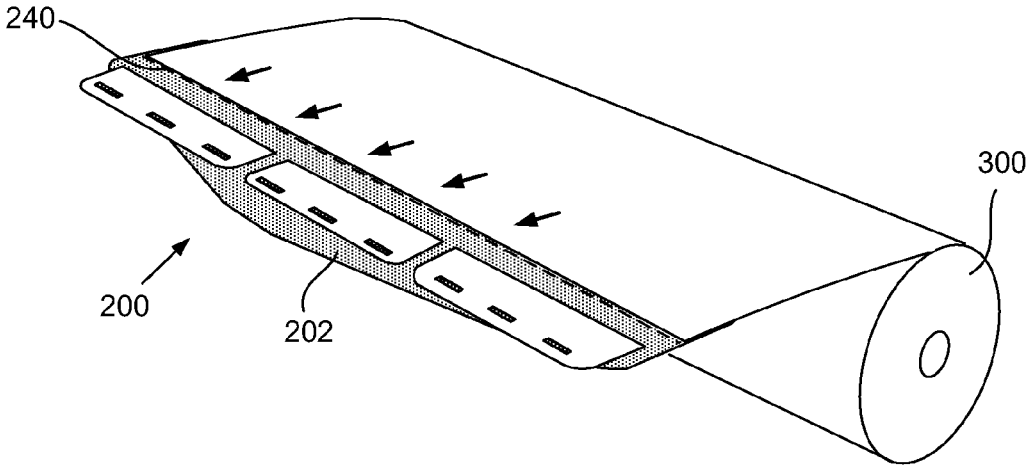
Figure 3C:
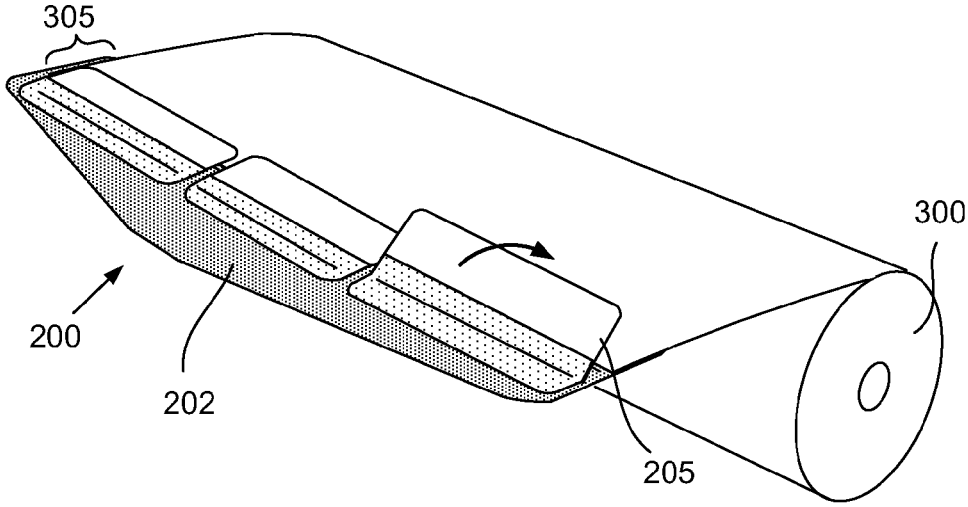

FIG. 3B shows the leading edge of the soft media (300) being placed onto the detachable stiffener (202) using the alignment mark (240) as a reference (block 410). FIG. 3C shows the flaps being manually closed to sandwich a leading portion (305) of the soft media (300) under the flaps (205) (block 415). As the flaps (205) are closed, magnets (235, FIG. 2B) in the flaps (205) are attracted to the corresponding magnets (230, FIG. 2B) on the detachable stiffener (202). The thickest portion of the media loading device (200) is the location where the magnet pairs (230, 235; FIG. 2B) are. At this point, the media loading device (200) includes the detachable stiffener (202), a flexible magnet (230, FIG. 2B) attached to the detachable stiffener (202), the soft media (300), the flexible magnet (235) attached to the flap (205), and the flap (205). In one implementation, this thickest portion of the media loading device (200) is approximately 5 millimeters or less. The dimensions of the media loading device (200), including length, width, and thickness of the detachable stiffener (202), the size and number of the flaps (205), and the number, size, and location of the magnets (230, 235) can all be adjusted as appropriate for a given application.

Figure 3D:
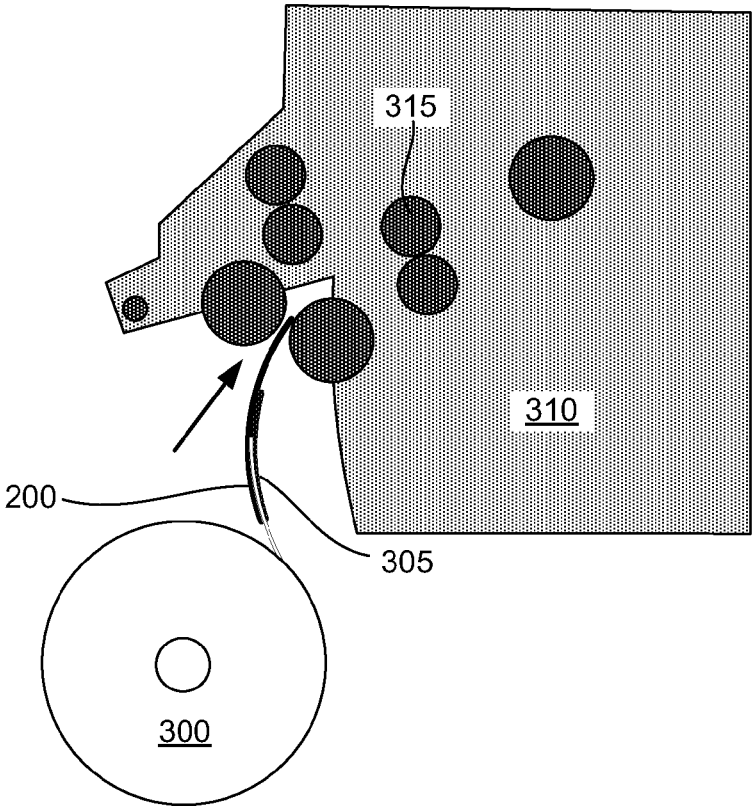

FIG. 3D shows a simplified cross section of a printer (310). The roll of soft media (300) is attached below the printer (310) so that it dispenses the soft media (300) upward into the printer (310). The media loading device (200) is attached to the leading portion (305) of the soft media (300). The media loading device (200) is manually fed into the media path (as shown by the arrow) until the automatic feed mechanisms in the printer (310) engage the media loading device (200) (block 420). As discussed above, the media loading device (200) has a sufficient length so that the operator can safely and conveniently push the media loading device (200) through the media path until the leading edge of the media loading device (200) engages the driving rollers (315). After the leading edge of the media loading device (200) is engaged by the driving rollers (315), the printer (310) can automatically complete the threading of the media loading device (200) through the printer (310)(block 425). The media loading device (200) pulls the soft media (300) behind it, while supporting its leading portion (305). As discussed above, the media loading device (200) has varying thickness along the media path direction. For example, the leading edge of the media loading device (200) includes only the detachable stiffener (202). As the media loading device (200) continues to move through the media path, it presents an increasingly thicker profile until it reaches the location of the magnets (230, 235). At this point, the media loading device (200) cross section includes the detachable stiffener (202), two magnets (230, 235), the soft media (300) and the flap (205). Printers are adapted to accommodate these varying thicknesses. For example, in nip regions where two rollers are in close proximity, at least one of the rollers may be spring loaded. As the thickness of the material passes through the nip changes, the spring loaded roller can dynamically move to accommodate the different thicknesses.

Figure 3E:
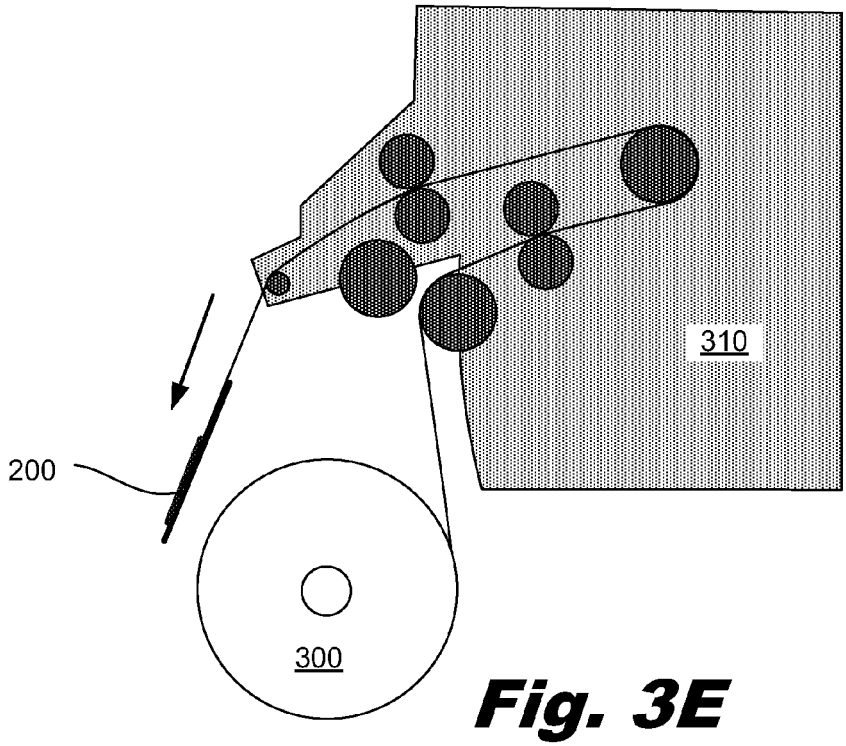
Figure 3F:
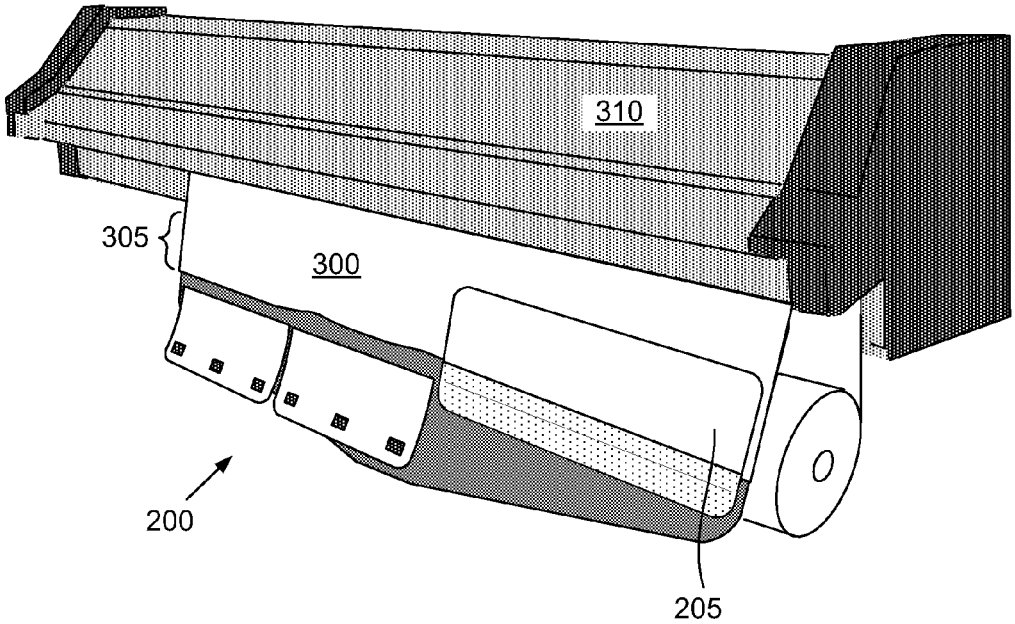

FIG. 3E shows the media loading device (200) exiting from the printer (310) (block 425) and the soft media (300) passing through the complete media path of the printer (310). FIG. 3F is a perspective view of the printer (310) with the soft media (300) passing from the roll, through the media path and to the output area of the printer (310). The media loading device (200) is then removed by manually opening the flaps (205) to release the leading portion (305) of the soft media (300) (block 430). The soft media (300) can then be adjusted within the media path as desired and printing can begin (block 435). The simplicity and speed of loading the soft media (300) using the media loading device (200) provides a substantially increase in printer throughput at very low cost. The tedious manual loading process for soft media can be entirely avoided.

Figure 5:
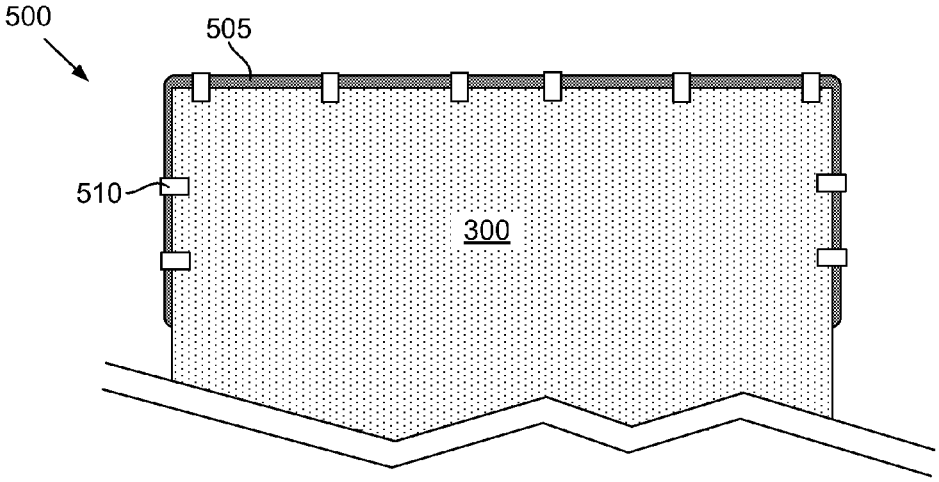
FIG. 5 is a top view of an illustrative media loading device, according to one example of principles described herein.

The media loading devices and methods described above are only illustrative examples. A variety of other configurations and methods could be used. FIG. 5 shows a media loading device (500) that includes a detachable stiffener (505) with a number of flexible clips (510) around three sides of the detachable stiffener (505). The soft media (300) is placed beneath the clips (510) and held by the clips (510) during the threading process. The clips (510) are attached to both the leading edge and the sides of the soft media (300). In one implementation, the thickness of the clips with the media inserted in less than 5 millimeters.

Figure 6A:
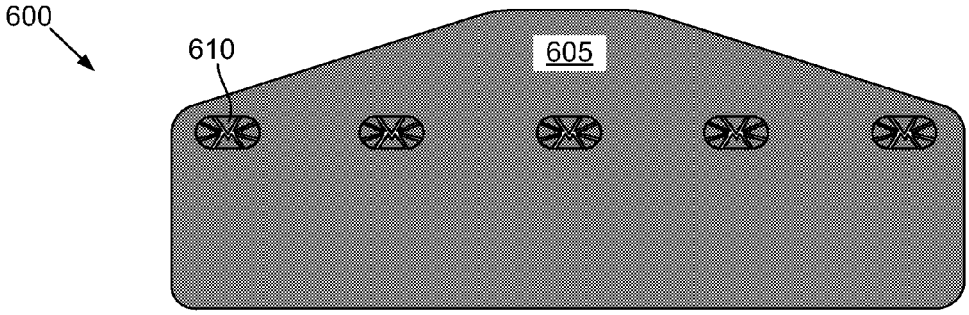
FIGS. 6A and 6B are top views of an illustrative media loading device, according to one example of principles described herein.
Figure 6B:
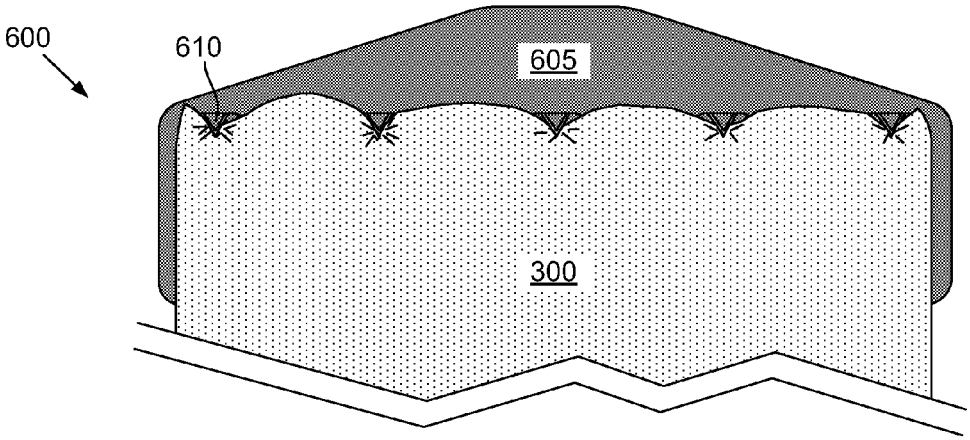

FIGS. 6A and 6B show an illustrative example of a media loading device (600) that includes a detachable stiffener (605) with a number of toothed apertures (610) punched through the detachable stiffener. These toothed apertures (610) are adapted to grip the soft media (300) when the media is forced through the apertures (610). FIG. 6B shows the leading edge of the soft media (300) that has been pushed through the toothed apertures (610) and is gripped so that it will remain connected to the media loading device (600) during the threading process. After the soft media (300) is threaded through the printer, the leading edge can be pulled out of the toothed apertures (610) to remove the media loading device (600). If the leading portion of the soft media (300) has been damaged by the teeth, the leading edge can be trimmed and discarded.

A variety of other methods can be used to attach the soft media to a detachable stiffener. For example, the soft media may be adhered to the detachable stiffener using tacky adhesive deposited on the detachable stiffener or media. Additionally or alternatively, the soft media may be attached to the detachable stiffener using removable adhesive tape. In another example, the media loading device may include a thin, flexible ferrous detachable stiffener and large flexible magnet flaps. The flaps adhere to the metal detachable stiffener and hold the soft media in place during the threading operation and can be peeled off the detachable stiffener after the threading operation is complete.

Figure 7:
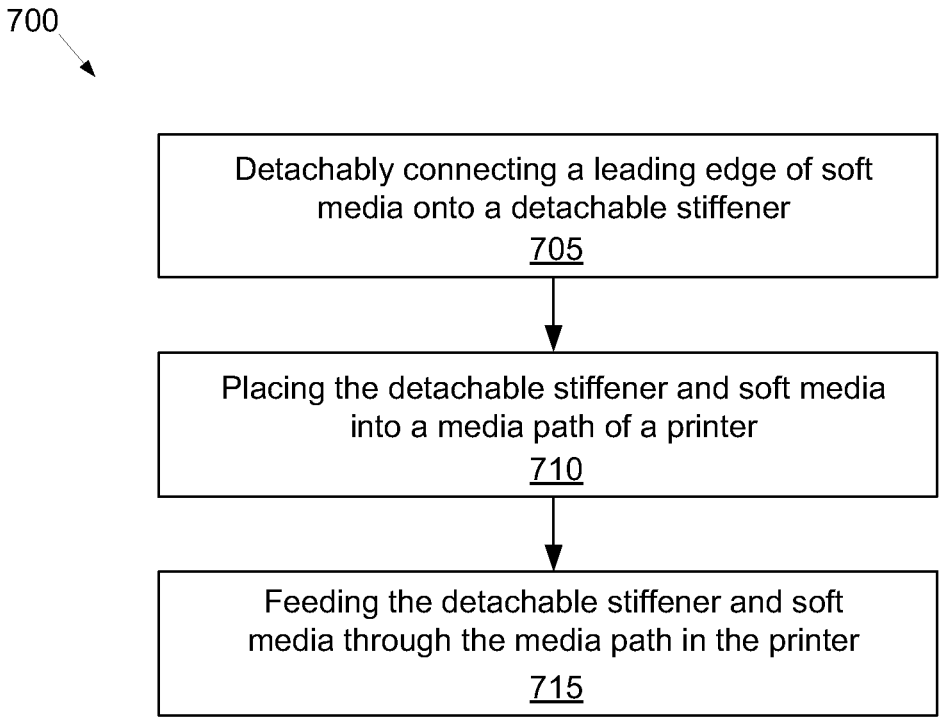
FIG. 7 is a flowchart of an illustrative method for using a media loading device to thread soft media through a media path of a printer, according to one example of principles described herein.

FIG. 7 is a flowchart of a method for using a media loading device to thread soft media through a media path of a printer. The leading edge or leading portion of the soft media is detachably connected to a detachable stiffener of the media loading device (block 705). The detachable stiffener and soft media are placed into the media path of the printer (block 710). The detachable stiffener and soft media are then fed through the media path (block 715). As discussed above the detachable stiffener supports the leading portion of the soft media as it passes through the media path and prevents the soft media from undesirably wrinkling or folding. The detachable stiffener draws the attached soft media behind it through the media path. Once the soft media has been threaded through the media path, the automatic functions of the printer can provide the desired control and motion of the soft substrate during the printing process.

The media loading device could be used in other applications to facilitate the handling of media. For example, very wide media can be challenging to handle even if the media is stiffer than typical soft media. For example, the HP SCITEX LX820 and LX850 printers accept media that is up to 3.2 meters in width. Even relatively stiff media that has a width of 3.2 meters can be floppy due to its large dimensional size. As discussed above, this can lead to folded edges, wrinkling, and other loading issues. Loading and handling of this very wide media is conventionally performed using two operators and includes raising the scan axis of the printer.

However, a media loading device can be made to support the leading portion of this wide media. The media loading device can be designed so that it provides the desired amount of rigidity across the leading edge of the media. This provides additional rigidity which allows a single operator to manipulate and load the wide media. The use of a media loading device may also eliminate the need to lift the scan axis of the printer to load the media.

In conclusion, the use of a media loading device to support the leading portion of soft media can result in reduced media loading times. This can provide higher printer throughput for soft media. The media loading device simplifies the soft media loading process and avoids media jams due to curled edges, folds, and wrinkles. The media path design can be less restrictive and can be designed without special features/clearances to manually load soft media.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A device comprising:

a detachable stiffener for supporting a leading portion of a soft media while threading the leading portion of the soft media through a media path of a printer, wherein the detachable stiffener is configured to be removed from the soft media before printing on the soft media;

a flap hingably connected to the detachable stiffener in which the leading portion of the soft media is sandwiched between the detachable stiffener and the flap, the detachable stiffener and the flap being configured to support the leading portion of the soft media as the soft media is fed through the media path of the printer; and a first magnet disposed on the detachable stiffener and a second magnet disposed on the flap, the first magnet being attracted to the second magnet such that the leading portion of the soft media is sandwiched between the magnets.

2. The device of claim 1, in which the detachable stiffener is detachably connectable to the soft media across substantially a full width of a leading edge of the soft media.

3. The device of claim 1, in which the length of the detachable stiffener is at least as long as the media path from an entrance of the media path to a driven roller.

4. The device of claim 1, in which a magnetic line orientation of the two magnets is perpendicular to a feed direction of the media loading device into the printer.

5. The device of claim 1, in which the flap is joined to the detachable stiffener along one edge by an adhesive fabric tape.

6. The device of claim 1, further comprising multiple flaps, the multiple flaps corresponding to different soft media widths.

7. The device of claim 1, further comprising an indicator line disposed on the detachable stiffener for aligning the leading portion of the soft media with the detachable stiffener.

8. The device of claim 1, in which the detachable stiffener is a flat substrate and the soft media comprises a roll of printable material.

9. The device of claim 1, in which the detachable stiffener is tapered so that a leading edge of the detachable stiffener is narrower than a trailing edge of the detachable stiffener.

10. The device of claim 1, in which the detachable stiffener is a flexible substrate printed on the printer.

11. The device of claim 1, in which the soft media is detachably connected to the detachable stiffener by clamps.

12. The device of claim 1, in which the soft media is detachably connected to the detachable stiffener by toothed apertures in the detachable stiffener.

13. The device of claim 1, in which the detachable stiffener does not support a trailing edge of the soft media.

14. A method for loading soft media comprising:

detachably connecting a leading edge of a roll of soft media onto a detachable stiffener;

placing the detachable stiffener into a printer;

feeding the detachable stiffener and the soft media through a media path in the printer;

removing the detachable stiffener from the soft media after feeding the detachable stiffener and the leading edge of the soft media through the media path and before printing on the soft media; and then printing on the soft media by advancing the soft media off the roll and through the printer;

in which detachably connecting the leading edge of the soft media to the detachable stiffener comprises:

opening a hinged flap connected to the detachable stiffener;

inserting the soft media; and closing the flap; and in which closing the flap comprises bringing a magnet on the flap into attractive proximity with a magnet on the detachable stiffener, the soft media being sandwiched between the magnet on the flap and the magnet on the detachable stiffener.

15. The method of claim 14, in which inserting the soft media comprises aligning the leading edge of the soft media with the detachable stiffener using an alignment mark printed on the detachable stiffener as a reference.

16. The method of claim 14 in which feeding the detachable stiffener and the soft media through the media path comprises:

manually pushing the detachable stiffener into the printer until the leading edge of the detachable stiffener engages with drive rollers; and advancing the drive rollers to pull the detachable stiffener and the soft media through the media path until the detachable stiffener exits the media path.

17. A system comprising:

a roll of soft printable media;

a printer;

a detachable stiffener to support a leading portion of the soft media while threading the leading portion of the soft media through a media path of the printer, in which the detachable stiffener comprises:

a flat plastic substrate substantially stiffer than the soft media, in which the substrate is configured to pass through the printer and receive ink from the printer to form a printed image on the substrate, in which the substrate is tapered so that a leading edge of the substrate is narrower than a trailing edge of the substrate;

a linear row of multiple flaps, the multiple flaps corresponding to different soft media widths;

hinges connecting the multiple flaps to the substrate; and a first magnet disposed on the substrate and a second magnet disposed on at first flap;

in which the leading portion of the soft media is sandwiched between the substrate and a first flap, the first magnet being attracted to the second magnet to hold the soft media in place between the substrate and the first flap such that the detachable stiffener pulls the leading edge of the soft media through the media path and unrolls additional soft media from the roll.

* * * * *